US007556396B2

(12) United States Patent
Kuo et al.

(10) Patent No.: US 7,556,396 B2
(45) Date of Patent: Jul. 7, 2009

(54) LAMP ASSEMBLY

(75) Inventors: Shu-Hsiung Kuo, Hsin-Tien (TW); Yen-Fu Liu, Hsin-Tien (TW); Yu-Yang Liu, Hsin-Tien (TW)

(73) Assignee: Ledtech Electronics Corp., Taipei County (TW)

( * ) Notice: Subject to any disclaimer, the term of this patent is extended or adjusted under 35 U.S.C. 154(b) by 0 days.

(21) Appl. No.: 11/979,746

(22) Filed: Nov. 8, 2007

(65) Prior Publication Data

US 2009/0122543 A1 May 14, 2009

(51) Int. Cl.
*F21S 4/00* (2006.01)
*H01R 33/08* (2006.01)

(52) U.S. Cl. ..... 362/217; 362/240; 439/240

(58) Field of Classification Search ..... 362/240, 362/217, 217.14–217.16, 649; 439/240, 439/241, 336

See application file for complete search history.

(56) References Cited

U.S. PATENT DOCUMENTS 2,918,645 A * 12/1959 Krupp ..... 439/11
3,401,242 A * 9/1968 McLaughlin ..... 200/51.07
7,052,171 B1 * 5/2006 Lefebvre et al. ..... 362/649
7,114,830 B2 * 10/2006 Robertson et al. ..... 362/240

FOREIGN PATENT DOCUMENTS

TW I266025 11/1993

* cited by examiner

*Primary Examiner*—John A Ward
(74) *Attorney, Agent, or Firm*—Rosenberg, Klein & Lee

(57) ABSTRACT

A lamp assembly includes at least one electrical socket and a tube. The electrical socket includes an insulating body and two connectors set in the insulating body. The insulating body has an insertion hole. The two connectors have a contact plate exposed in the insertion hole. The tube has two terminal lugs disposed at least at one end thereof. The end of the tube and the two terminal lugs are inserted and installed in the insertion hole of the electrical socket. The terminal lugs electrically contact the contact plate of the connector. The end of the tube installed in the insertion hole is rotatable, the lighting angle can be adjusted. Thus, the tube can be electrically connected with the electrical socket quickly, the tube is lit instantly, and the tube can be rotated to adjust the lighting angle.

7 Claims, 9 Drawing Sheets

LAMP ASSEMBLY

BACKGROUND OF THE PRESENT INVENTION

1. Field of the Present Invention

The present invention relates to a lamp assembly, and particularly relates to an LED lamp assembly that is capable of adjusting the lighting angle by rotating a tube thereof.

2. Background of the Present Invention

Most conventional fluorescent lamps or LED lamps, are assembled by inserting terminal lugs of a tube into electrical sockets. A socket assembly is disclosed in Taiwan Patent No. I266025, entitled "Connection base capable of insertions at opposite faces", Published on 11, Nov., 2006. The socket assembly includes two sockets and a space between them where a fluorescent tube can be clamped. The two sockets are of identical structure and are symmetrical to each other. The sockets include two symmetrical, curved slots at their sides facing the tube, and two rotatable connectors disposed in the slots respectively. The connectors have two contact plates extending from them. The two contact plates are employed to clip terminal lugs of a conventional tube after the terminal lugs of the tube are rotated through a predetermined angle in the slots. The rotatable connector plates are electrically connected with wires to a power supply. In addition, a plurality of tubes can be connected in series via the socket assembly.

However, the terminal lugs of said socket assembly will not contact the connectors immediately after insertion into the curved slots. Electrical contact between the terminal lugs and the connectors is established only after rotation of the fluorescent tube. The necessity to rotate the tubes after their insertion creates an inconvenience during the assembly and requires additional time.

In addition, after the tube is assembled to the socket, the lighting angle is fixed. However, LED tubes provide lighting only at a specific angle and thus can require adjustment of their rotational position. Hence, an improvement over the prior art is required to overcome the disadvantages thereof.

SUMMARY OF THE INVENTION

The object of the present invention is therefore to provide a lamp assembly, employing a tube and an electrical socket, which can accomplish fast electrical connection between the tube and the socket. Terminal lugs of the tube can contact with corresponding connectors immediately upon insertion of the tube into the electrical socket. Thereby, fast electrical connection and convenient assembly are achieved.

The object of the present invention is furthermore to specify a lamp assembly in which the tube is still rotatable after the assembly with the electrical socket, in order to provide variable angle lighting.

According to the present invention, the above objects are achieved by providing a lamp assembly including at least one electrical socket and at least one tube. The electrical socket has an insulating body and two connectors set in the insulating body. The insulating body has an insertion hole formed therein. Each of the two connectors have contact plate exposed in the insertion hole. The tube has two terminal lugs disposed at least one end thereof. The end of the tube and the two terminal lugs are inserted and installed in the insertion hole of the electrical socket. The contact plates of the connectors is in electrical contact with the terminal lugs. The tube installed in the insertion hole is rotatable, an the lighting angle is thus adjustable.

The advantages of the present invention over the prior art are:

The contact plate of the socket is sufficiently large so that it electrically connects to the terminal lugs of the tube as soon as the tube is inserted. Thus, the assembly becomes faster and more convenient.

The large contact area between the tube and the connectors guarantee electrical connection of the tube with the electrical socket while the tube is rotated in the insertion hole. Therefore, the lighting angle can be adjusted after assembly.

To provide further understanding of the present invention, the following detailed description illustrates embodiments and examples of the present invention. Examples of the more important features of the present invention have thus been summarized broadly so that the detailed description thereof that follows may be better understood, and so that the contributions to the art may be appreciated. There are, of course, additional features of the present invention that will be described hereinafter which will form the subject of the claims appended hereto.

BRIEF DESCRIPTION OF THE DRAWINGS

These and other features, aspects, and advantages of the present invention will become better understood when taking into account the following description, appended claims, and accompanying drawings, where:

DETAILED DESCRIPTION OF THE EMBODIMENTS

Figure 1:
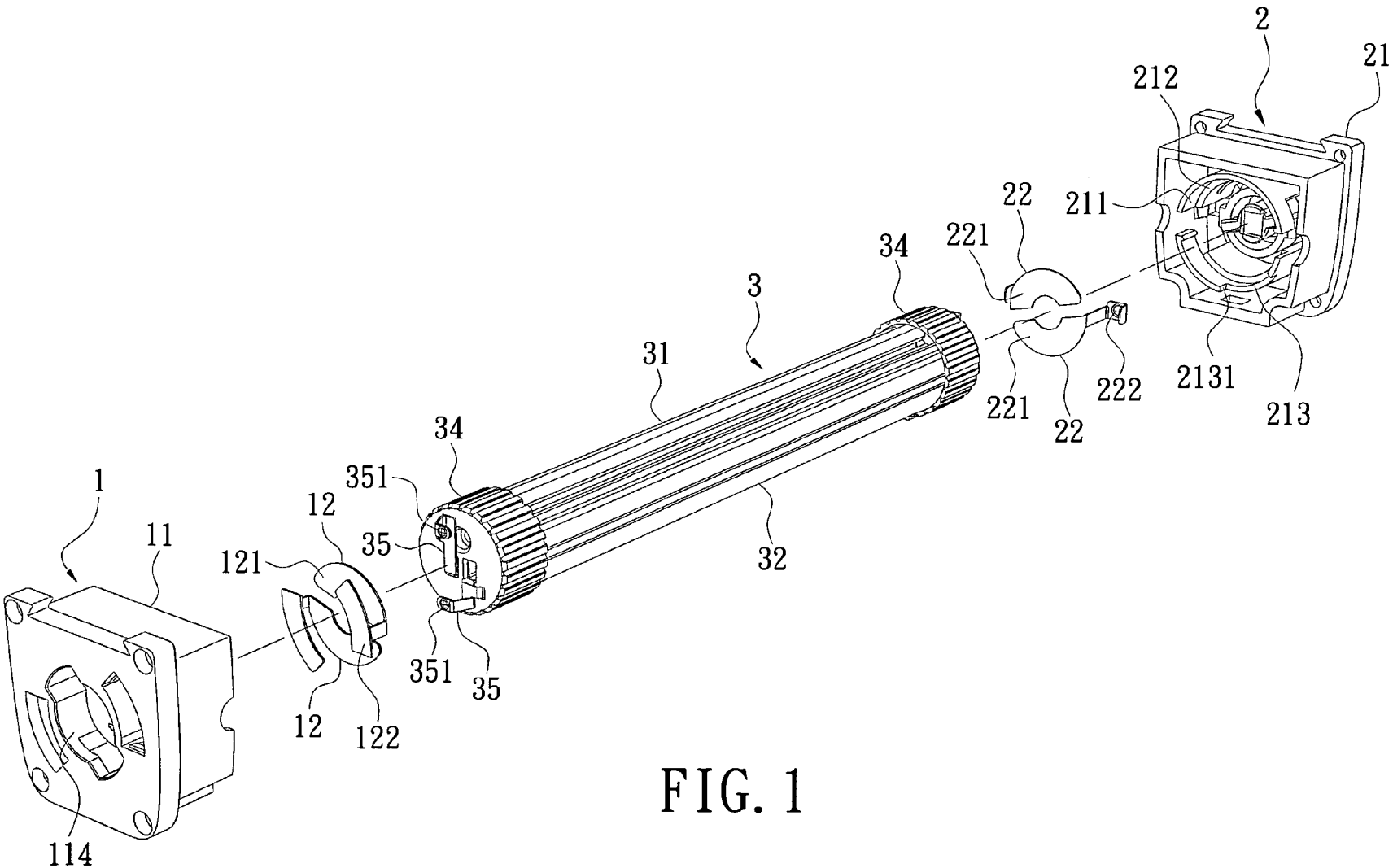
FIG. 1 is a first exploded view of a lamp assembly according to the present invention.

Referring to FIGS. 1 to 4, a lamp assembly disclosed in the present invention includes a first electrical socket 1, a second electrical socket 2 and a tube 3. The first electrical socket 1 includes a first insulating body 11 and two connectors 12. The first insulating body 11 is made of synthetic material. The first insulating body 11 is made integrally in one piece or as an assembly. The first insulating body 11 has a first insertion hole 111, which has a round shape, formed therein for receiving one end of the tube 3. The tube 3 is rotatable in the first electrical socket 1. The first insulating body 11 further includes a first inner support surface 112 annularly surrounding the first insertion hole 111, and the end of the tube 3 is sustained by the first inner support surface 112. The first insulating body 11 includes a first orientation notch 113 at the edge of the first insertion hole 111, and two first obstruction surfaces 1131 formed at two ends of the first orientation notch 113. The two first obstruction surfaces 1131 are separated by a predetermined central angle (for example, 45 degrees). The first insulating body 11 includes a first clamp portion 114 arranged at an outer surface thereof. In this embodiment, the first clamp portion 114 is a clamp hole for connecting another lamp assembly in series.

The two first connectors 12, conductive and flexible, are made of metal sheets bent into an appropriate shape. The two first connectors 12 are secured in the first insulating body 11 by heat sealing or clamping. Each of the first connectors 12 has a first contact plate 121 and a second contact plate 122. The first contact plates 121 and the second contact plates 122 have an annular shape. The first contact plates 121 are set in the first insertion hole 111 of the first insulating body 11. The second contact plates 122 protrude outside the outer surface of the first insulating body 11 (shown in FIG. 2) for electrically connecting to a power supply. The second contact plates 122 transmit the power to the two first contact plates 121 of the first connector 12. The two first contact plates 121 of the two corresponding first connectors 12 are located opposite to each other. The first contact plate 121 electrically connects with terminal lugs 35 of an end of the tube 3. The first contact plate 121 has a large contact area to enter into electrical contact with the terminal lugs 35 of the tube 3. In other words, the contact plate 121 has an extension where the respective terminal lugs 35 can be inserted so as to contact the first contact plate 121 with the terminal lugs 35.

The second electrical socket 2 includes a second insulating body 21 and two second connectors 22. The second insulating body 21 is made of synthetic material. The second insulating body 21 is made integrally in one piece or as an assembly. The second insulating body 21 has a round, second insertion hole 211 formed therein. The second insertion hole 211 is used to receive the opposite end of the tube 3. The tube 3 can rotate in the second electrical socket 2. The second insulating body 21 includes a second inner support surface 212 annularly surrounding the second insertion hole 211, and the opposite end of the tube 3 is sustained by the second inner support surface 212. The second insulating body 21 includes a second orientation notch 213 at the edge of the second insertion hole 211, and two second obstruction surfaces 2131 define the two ends of the second orientation notch 213. The central angle between the two second obstruction surfaces 2131 may amount to 45°. The second insulating body 21 includes a second clamp portion 214 (shown in FIG. 5) arranged at an outer surface thereof and matches with the first clamp portion 114. In this embodiment, the second clamp portion 214 is a clamping block for serially connecting another lamp assembly.

The two conductive and flexible second connectors 22 are made of metal sheets bent into an appropriate shape. The two second connectors 22 are secured in the second insulating body 21 by heat sealing or clamping. Each of the second connectors 22 has a third contact plate 221 and a fourth contact plate 222. The third contact plates 221 have an annular shape. The third contact plates 221 are set into the second insertion hole 211 of the second insulating body 21. The fourth contact plates 222 protrude out of the outer surface of the second insulating body 21 (shown in FIG. 5) and electrically connect to a power supply. The fourth contact plates 222 transmit power to third contact plates 221 of the second connector 22. The two third contact plates 221 of the two corresponding second connectors 22 are located opposite to each other. The third contact plates 221 electrically connect to terminal lugs 35 of the opposite end of the tube 3. The large contact areas of the third contact plates 221 enter in electrical contract with the terminal lugs 35 of the tube 3*t*

Figure 7:
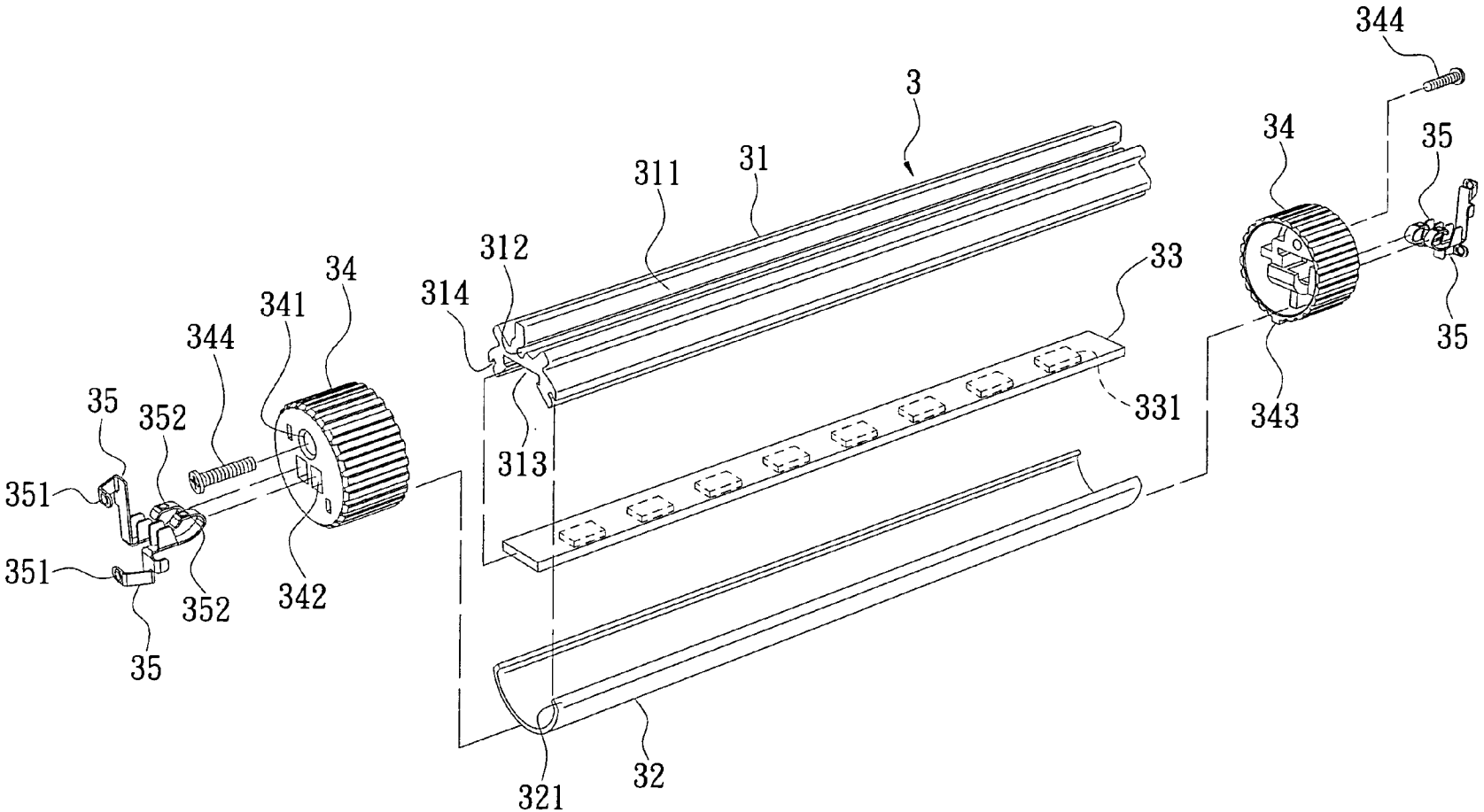
FIG. 7 is an exploded view of the lamp assembly according to another embodiment of the present invention.
Figure 8:
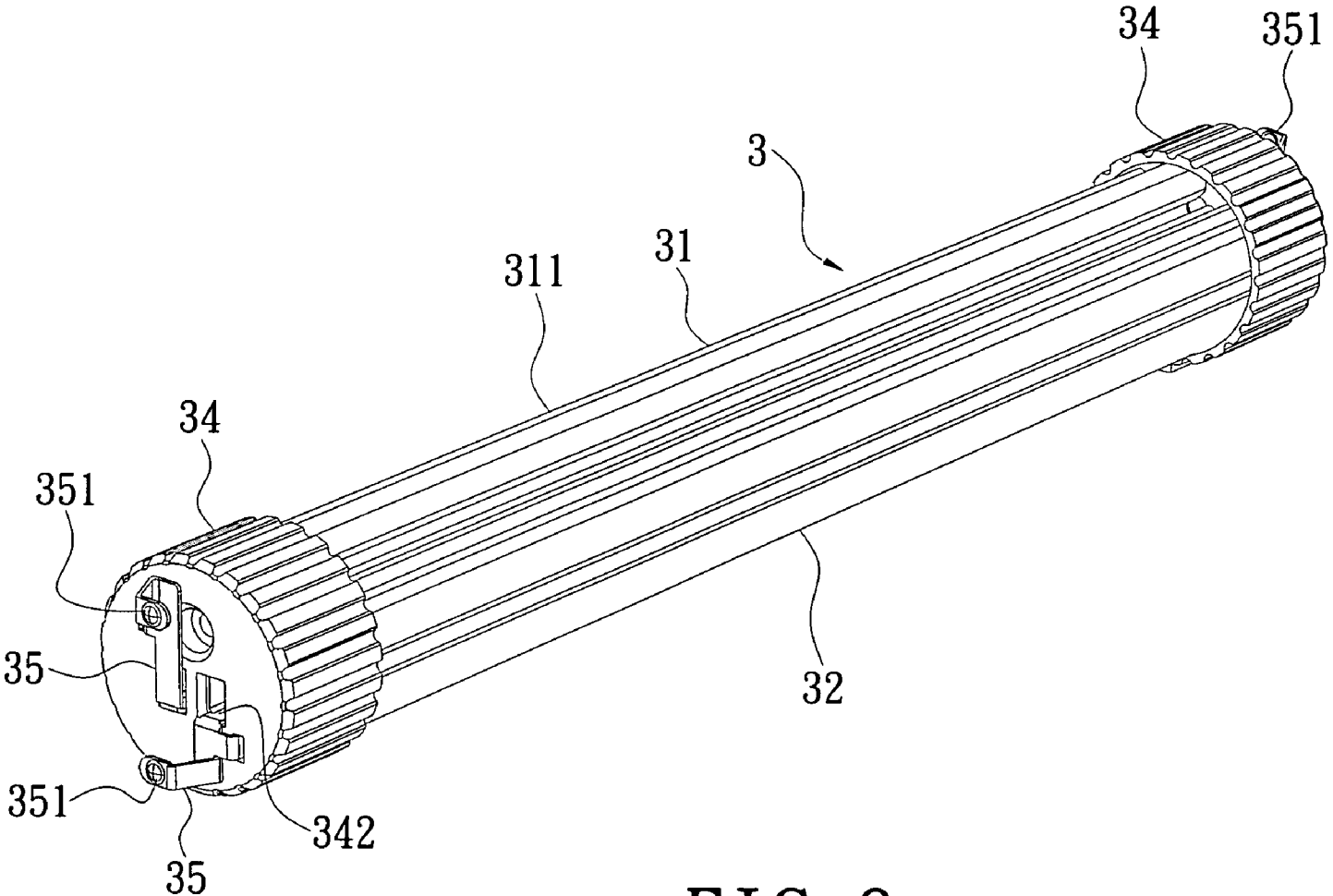
FIG. 8 is a perspective view of the lamp assembly according to another embodiment of the present invention.

The tube 3 is an LED tube. The tube 3 includes a front casing 31 and a rear casing 32 with a cavity between them, a printed circuit board 33, two end caps 34, and four terminal lugs 35 (illustrated in FIGS. 7 and 8). In this embodiment, the rear casing 31 is made by aluminum extrusion and has an inner surface, facing the tube and an outer surface, facing in the opposite direction. The rear casing 31 has an elongated shape and has a plurality of heat dissipation fins 311 on its outer surface. The rear casing 31 has a fastening hole 312 on its outer surface, and the fastening hole 312 extends between the two opposite ends of the rear casing 31. The rear casing 31 has a fixation groove 313 at its inner surface which matches the printed circuit board 33. The rear casing 31 further includes two clamping grooves 314 formed at its sides.

The length of the front casing 32 corresponds to the length of the rear casing 31. The front casing 32 is translucid. The front casing 32 includes two clamping edges 321 engaging with the clamping grooves 314 of the rear casing 31, so that the rear casing 31 and the front casing 32 are secured to each other.

The printed circuit board 33 is located in the fixation groove 313 of the rear casing 31. The printed circuit board 33 has a plurality of LEDs 331 arranged with spaces between them and facing the front casing 32. The LEDs 331 are electrically connected to the printed circuit board 33. The LEDs 331 are lit after power is provided.

The two end caps 34 are round hollow caps. Each of the two end caps 34 bears a fixation hole 341 and two connection holes 342. The fixation hole 341 and the connection holes 342 penetrate the corresponding end caps 34 in direction of their rotational axis from their outer to their inner surface. Each of the two end caps 34 has a protruding portion 343 disposed on their lateral outer surface. The two end caps 34 are holding together the two opposite ends of the rear casing 31 and front casing 32. The screws 344 penetrate the fixation holes 341 and engage at either end of the fastening hole 312 of the rear casing 31.

The terminal lugs 35 of good conductivity and flexibility are made of metal sheets bent into an appropriate shape. Each of the terminal lugs 35 includes a first terminal portion 351 and a second terminal portion 352 at their two ends. The four terminal lugs 35 are set in the four connection holes 342 of the two end caps 34. Each of the two end caps 34 is equipped with two terminal lugs 35. The second terminal portions 352 of the terminal lugs 35 extend into the end caps 34 electrically connecting to the printed circuit board 33. The first terminal portions 351 of the terminal lugs 35 protrude out of the end caps 34 electrically connecting to the first connectors 12 of the first electrical socket 1 and to the second connectors 22 of the second electrical socket 2, respectively.

Figure 2:
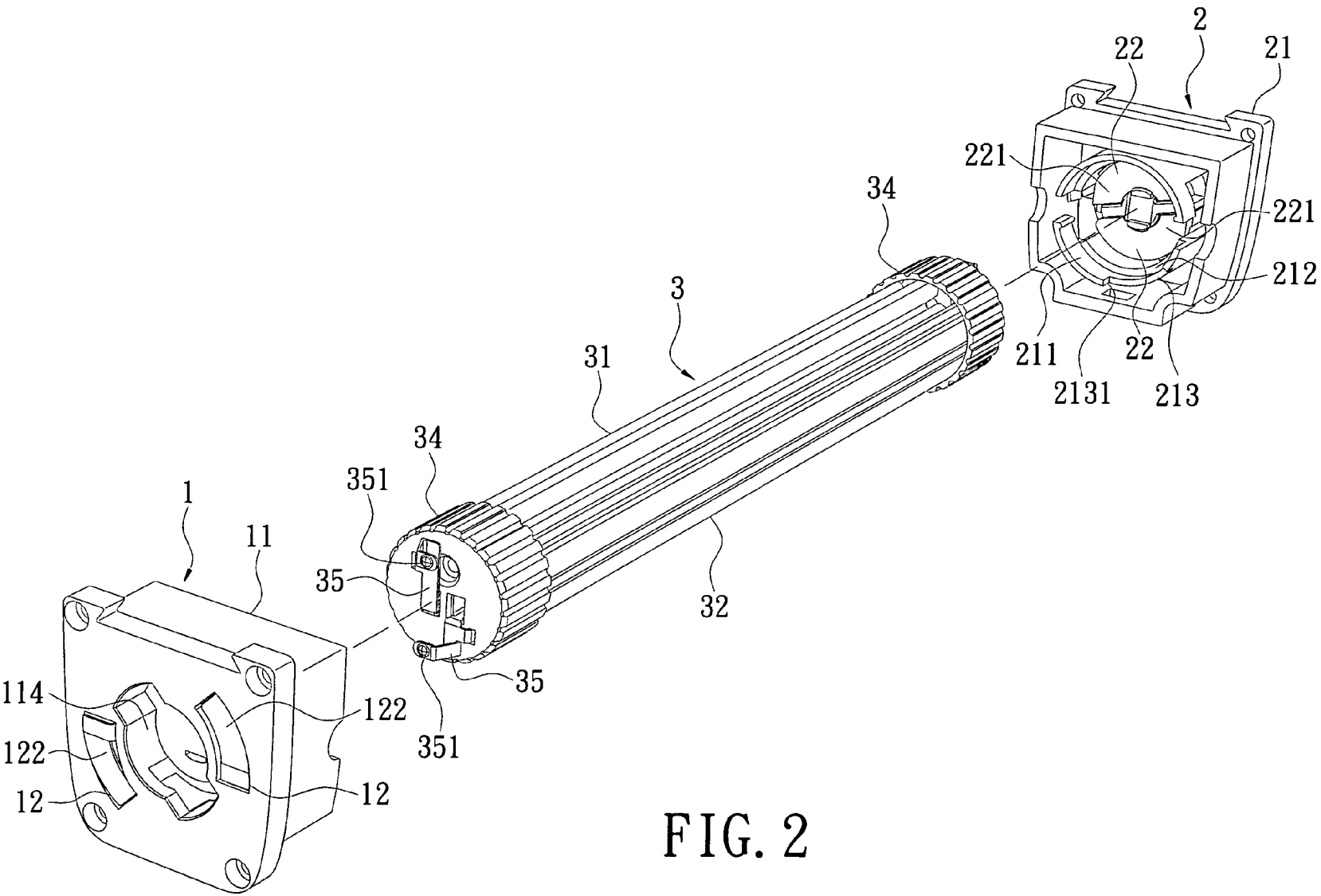
FIG. 2 is a second exploded view of the lamp assembly according to the present invention.
Figure 3:
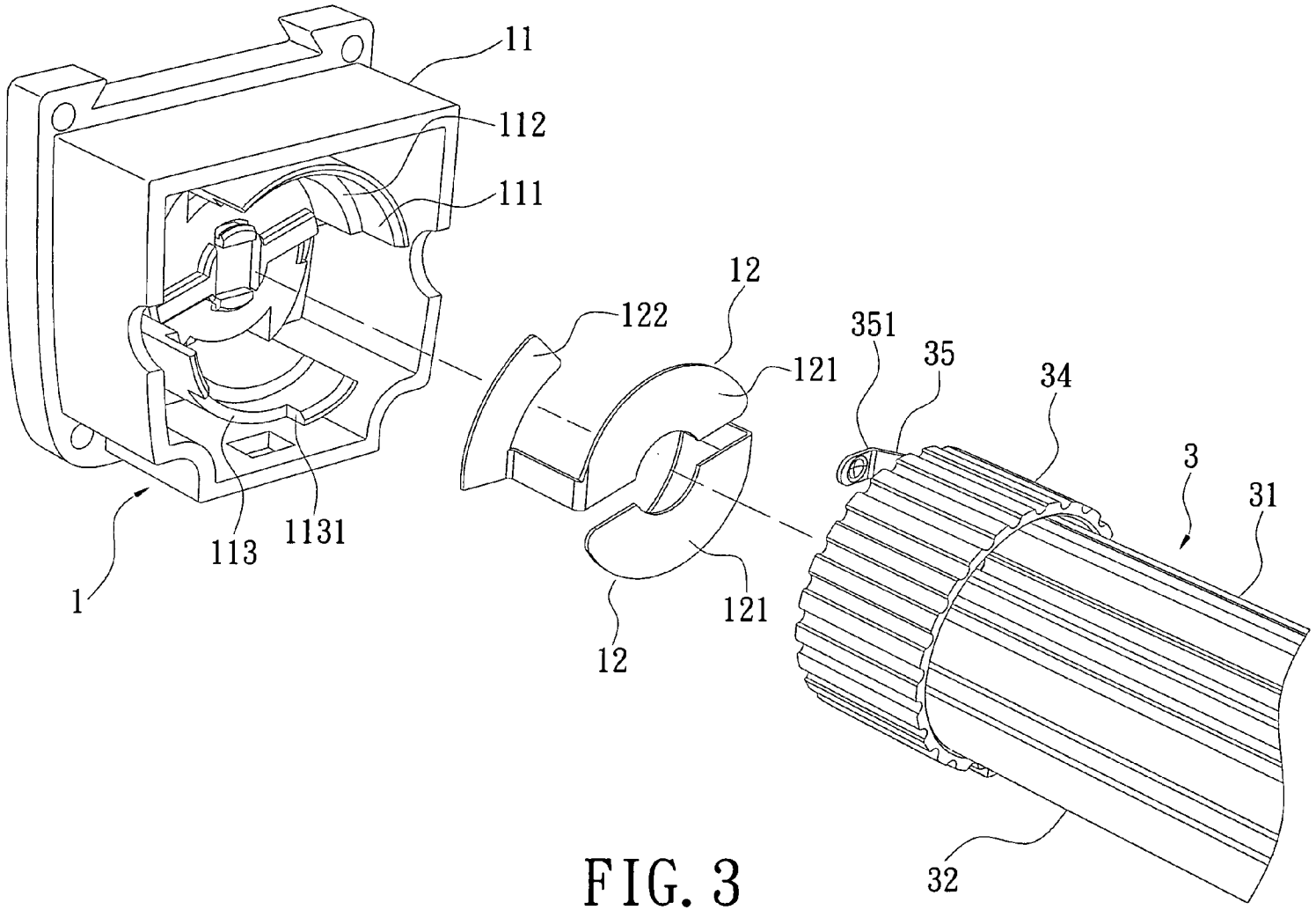
FIG. 3 is a third exploded view of the lamp assembly according to the present invention.
Figure 4:
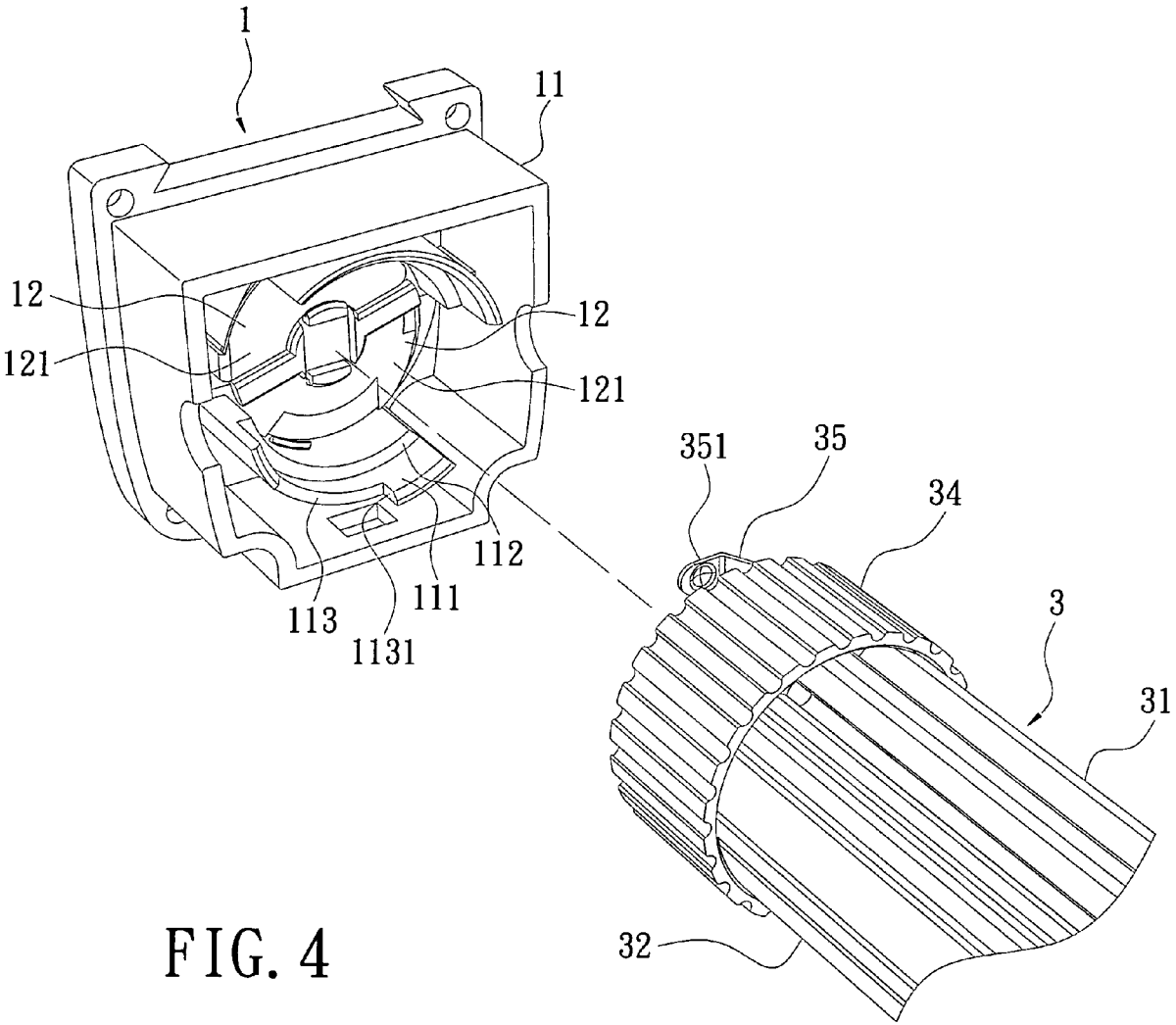
FIG. 4 is a fourth exploded view of the lamp assembly according to the present invention.
Figure 6:
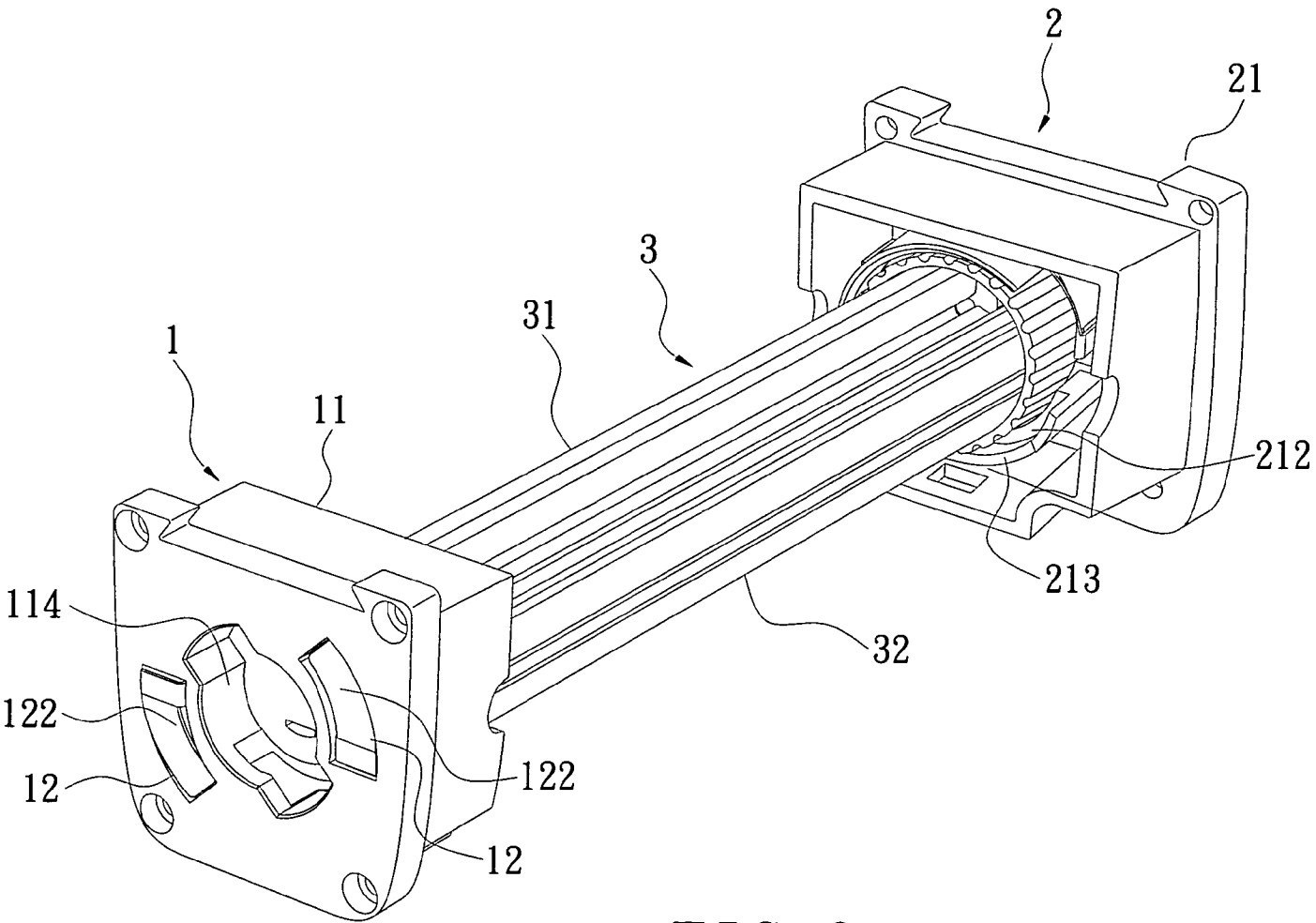
FIG. 6 is a perspective view of the lamp assembly according to the present invention.

Two opposite ends of the tube 3 insert into the first and second electrical sockets 1 and 2 respectively, as shown in FIGS. 2, 4 and 6. When the two ends of the tube 3 and their terminal lugs 35 are inserted in the first insertion hole 111 of the first electrical socket 1 and the second insertion hole 211 of the second electrical socket 2 respectively, the two end caps 34 are sustained by the first inner support surface 112 and the second inner support surface 212. The two end caps 34 can rotate in the first inner support surface 112 and the second inner support surface 212, respectively. The first terminal portions 351 of the terminal lugs 35 touch the first contact plates 121 of the corresponding first connector 12 of the first electrical socket 1 and the third contact plates 221 of the corresponding second connector 22 of the second electrical socket 2; the tube 3 thereby connects the first and second electrical sockets 1, 2. The power can be transmitted to light up the tube 3 via the first and second electrical sockets 1, 2.

Figure 9:
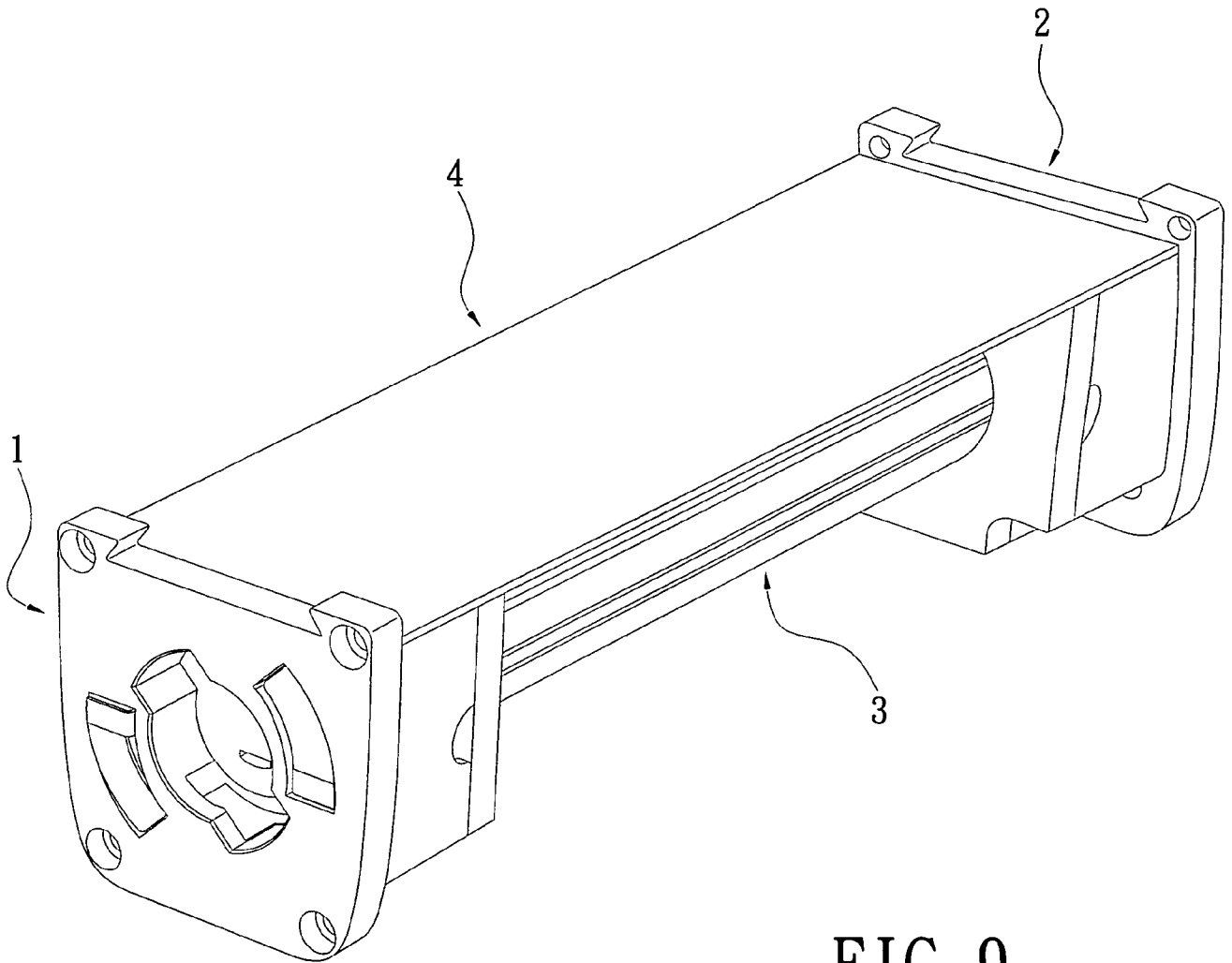
FIG. 9 is a perspective view of the lamp assembly fitted with a lampshade according to the present invention.

Referring to FIG. 9, the lamp assembly according to the present invention further includes a lampshade 4 covering the tube 3.

The first contact plate 121 of the first connector 12 of the first electrical socket 1 provides a large contact area, so does the third contact plate 221 of the second connector 22 of the second electrical socket 2. When the tube 3 is inserted into the first insertion hole 111 of the first electrical socket 1 and the second insertion hole 211 of the second electrical socket 2, the first terminal portions 351 of the terminal lugs 35 immediately touch the first contact plate 121 of the first connector 12 and the third contact plate 22 of the second conduct sheet 22. Thus, fast electrical connection between the tube, the first electrical socket 1, and the second electrical socket 2 is achieved, thereby achieving a quick assembly and making the assembly also very convenient.

Furthermore, the two ends of the tube 3 are rotatable in the first insertion hole 111 and the second insertion hole 211. The two first contact plates 121 of the first connectors 12 and the two third contact plates 221 of the second connectors 22 have an annular shape for providing a large contact area, in order to guarantee contact with the first terminal portions 351 of the terminal lugs 35 of two ends of the tube 3. After the tube 3 is assembled to the first and second electrical sockets 1, 2, the tube 3 can be rotated to adjust the lighting angle thereof. When the tube 3 rotates, the protruding portions 343 of the end caps 34 move in the first orientation notch 113 and the second orientation notch 213, respectively. The rotation angle is limited by the abutment of the protruding portions 343 at the first obstruction surface 1131 of the first orientation notch 113 and at the second obstruction surface 2131 of the second orientation notch 213.

Figure 5:
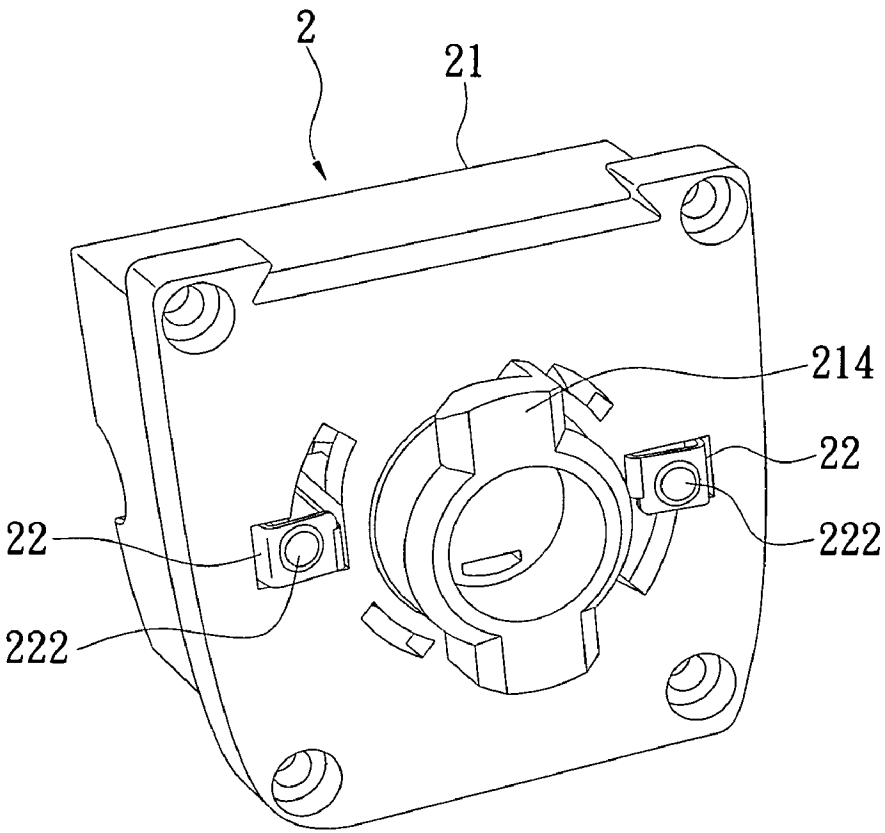
FIG. 5 is a perspective view of a second electrical socket of the lamp assembly according to the present invention.

As indicated by FIGS. 5 and 6, lamp assemblies of the present invention can be connected in series to one another by utilizing the first clamping portion 114 of the first electrical socket 1 engaging with the second clamping portion 214 of the second electrical socket 2. The second contact plates 122 of the first connectors 12 of the first electrical socket 1 connect to the fourth contact plates 222 of the second connectors 22 of the electrical socket 2, so that the lamp assemblies serially connect to each other.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A lamp assembly, comprising:

two electrical sockets, each socket including an insulating body and a connector set in the insulating body, wherein the insulating bodies each include a clamp portion arranged at an exterior surface thereof, the clamp portion of the first insulating body being formed to mate with a further clamp portion of a second insulating body of another lamp assembly, each of the insulating bodies has an insertion hole formed therein, the two connectors have two pairs of contact plates respectively, the two pairs of contact plates being parallel and displaced each to the other, an inner pair of contact plates being annular-shaped and disposed in the insertion holes of the insulating bodies, an outer pair of contact plates extending beyond an outer surface of the insulating bodies; and a tube including two terminal lugs disposed at each end thereof, wherein the two ends of the tube are inserted and installed respectively in an insertion hole of one of the electrical sockets; the inner pair of contact plates having an extended contact area defined by said annular shape, the terminal lugs making frontal electrical contact with the extended area of the contact plates of the connectors when one end of the tube has been installed in the first insulating body and another end of the tube has been installed in the second insulating body; wherein the tube is rotatable, and the lighting angle of the tube is thereby adjustable.

2. The lamp assembly as claimed in claim 1, wherein the insertion hole has a round shape corresponding to the end of the tube.

3. The lamp assembly as claimed in claim 1, wherein the insulating body further includes an inner support surface annularly surrounding the insertion hole, and the end of the tube is sustained against the inner support surface.

4. The lamp assembly as claimed in claim 1, wherein the insulating body includes an orientation notch, and an obstruction surface formed at each end of the orientation notch; wherein the end of the tube has a protruding portion movable disposed in the orientation notch, the protruding portion abuts the obstruction surface of the orientation notch.

5. The lamp assembly as claimed in claim 1, wherein the tube is an Light Emitting Diode (LED) tube.

6. The lamp assembly as claimed in claim 5, wherein the tube includes a front casing, a rear casing, a printed circuit board, and two end caps, and a hollow cavity surrounded by the front casing and the rear casing; wherein the front casing is translucent, the printed circuit board is arranged in the rear casing, the printed circuit board has a plurality of light emitting diodes (LEDs), the two end caps enclose two opposite ends of the front casing and the rear casing, wherein the two terminal lugs are disposed on one of the end caps and are electrically connected with the printed circuit board.

7. The lamp assembly as claimed in claim 6, wherein each of the two terminal lugs has a first terminal portion and a second terminal portion; wherein the first terminal portion protrudes out of one of the end caps electrically connecting to one of the contact plates of the connectors in the socket, the second terminal portion extends into one of the end caps electrically connecting to the printed circuit board.

* * * * *